United States Patent [19]

Amundson

[11] Patent Number: 4,489,940

[45] Date of Patent: Dec. 25, 1984

[54] PRACTICE GOALTENDER

[76] Inventor: Arthur G. Amundson, 4515 Oneida St., Duluth, Minn. 55804

[21] Appl. No.: 428,154

[22] Filed: Sep. 29, 1982

[51] Int. Cl.[3] ..... A63B 69/00

[52] U.S. Cl. ..... 273/1 B

[58] Field of Search ..... 273/1 B, 1.5 A, 407, 273/408, 428, 26 A, 127 R, 127 B

[56] References Cited

U.S. PATENT DOCUMENTS

| | | | |
|---|---|---|---|
| 3,552,749 | 1/1971 | Piggotte | 273/1.5 A |
| 3,765,675 | 10/1973 | DiMarzio | 273/1 B |
| 3,841,630 | 10/1974 | Renna | 273/1 B |
| 3,887,181 | 6/1975 | Samaras | 273/1 B |
| 4,149,723 | 4/1979 | Simon | 273/428 X |
| 4,168,062 | 9/1979 | McCarthy et al. | 273/1 B |
| 4,344,621 | 8/1982 | Baker | 273/1 B X |

FOREIGN PATENT DOCUMENTS

| | | | |
|---|---|---|---|
| 1071255 | 2/1980 | Canada | 273/1 B |
| 461588 | 10/1913 | France | 273/407 |
| 603179 | 8/1978 | Switzerland | 273/1 B |

OTHER PUBLICATIONS

American Rifleman 6-1967, p. 97.

*Primary Examiner*—Paul E. Shapiro

[57] ABSTRACT

The apparatus disclosed is a life-size silhouette figure of a goaltender, preferably for the game of ice hockey, mounted on a movable support base, and including a rigid board undersurface attached to the base support stand, a resilient overlayer outwardly covering the support surface, and an outer covering over the entire resilient layer and partially compressing the resilient layer against the board surface. An embodiment of the invention includes a hinge attachment between the board structure and the base support stand, and removable braces between the base support stand and the rear of the board structure.

2 Claims, 6 Drawing Figures

PRACTICE GOALTENDER

BACKGROUND OF THE INVENTION

The present invention relates to sporting activities, and more particularly to the sport of ice hockey, wherein a particular and significant aspect of the sport relates to the development of shooting skills for accurately shooting a hockey puck into a net past a goaltender.

The sport of ice hockey has progressed in the development of skating, shooting and goaltending skills to a point wherein one may predict the defensive moves which result from most offensive play situations. In particular, the skills of goaltending have evolved into the solution of rather elementary geometry and physics problems, wherein the goaltender intuitively positions himself between the shooter and the goal net at a distance from the goal net wherein the goaltender's silhouette most nearly obscures the total net from all possible lines of flight of the hockey puck from the shooting point. In this situation, the goaltender is frequently some distance away from the front of the net in order to provide the largest blocking silhouette from the point of shooting. From the offensive point of view, this defensive move requires extremely accurate shooting skills in order that the puck may be fired into the narrow portion of the net which remains unobscured by the goaltender's silhouette. The development of accurate shooting skills can only be accomplished through constant and intensive practice, but extended practice by all of the members of the hockey team over considerable time periods is extremely wearing on goaltenders. High probability of injury to the goaltender exists, especially when hundreds of high velocity shots are aimed at or near the goaltender over an extended time period.

On the other hand, if a goaltender is not used to help develop these skills, a very unrealistic practice activity results. It is difficult, if not impossible, for a hockey player to determine whether any given shot would have escaped the goaltender's silhouette had the goaltender been in position and, as a result, this form of practice usually results in the players aiming more or less for the center of the goal.

In the prior art the problem has been addressed in various ways, none of which are totally satisfactory. U.S. Pat. No. 3,840,228, issued Oct. 8, 1974 discloses a V-shaped board which is attached to and positioned slightly in front of the goal net. A goaltender image is drawn thereon, but the entire board acts as a deflecting surface for pucks which may be shot generally in the direction of the goal. This invention provides a generally unsatisfactory result in the development of the skills described herein, for it only simulates a target shooting condition relatively close to the goal, and the area of the board surface is considerably larger than the goaltender's silhouette, providing an unrealistic practice shooting target. U.S. Pat. No. 3,856,298, issued Dec. 24, 1974 discloses a perforated board surface covering the entire goal net opening. The idea of this invention is to provide passages through the board at selective locations in order that skills might be developed in aiming for these openings. This invention may assist in the development of accuracy skills, but it is unrealistic in the sense that the shooter is not faced with a realistic situation for shooting from long distances, wherein the actual goaltender is spaced a considerable distance in front of the goal net and between the shooter and the net. The accuracy skills developed in utilizing this invention may not be applicable to actual game conditions. Similarly, U.S. Pat. No. 3,887,181, issued June 3, 1975, discloses a full coverage board surface over the goal mouth, having selective openings which may be controllably opened and closed for developing accuracy in shooting. This invention also presents an unrealistic target situation for shooters firing at the goal from a distance in front of the goal. The shooter is not confronted with a goaltender's silhouette intermediate himself and the goal and spaced any distance at all from the front of the goal mouth. U.S. Pat. No. 3,765,675, issued Oct. 16, 1973 utilizes a slightly different approach to the development of these skills, in this invention, a large enclosure is utilized to confine the shooter and a simulated goaltender and net. The goaltender is mechanically movable across the goal mouth and the shooter attempts to aim the puck at areas of the net uncovered while the goaltender has moved to another area of the net. This invention may provide some aid in assisting the development of skills in shooting at a moving target or shooting away from a moving target, but it suffers from the same disadvantages recited for the other prior art patents.

SUMMARY OF THE INVENTION

The present invention comprises a life-size silhouette figure, having the silhouette of a goaltender in defensive position, the silhouette figure being attached at one end of a base support member and having at least one brace extending proximate the rear upper portion of the silhouette back to the rear portion of the base member. The silhouette figure is formed of a board surface having a resilient foam material overlaying the forward side of the surface, and having a protective covering partially compressing the foam material against the board surface. The silhouette figure may be adapted for attaching a goal stick thereto, and may be further adapted for the attachment of various items of a goaltender's uniform, including leg pads, mask, and gloves. The base of the invention may be adapted for utilization with wheels on dry surface, or for utilization with ice gripping points for stabilization on hockey rinks. One embodiment of the invention utilizes both wheels and ice gripping points, the wheels being adjustable into two positions to enable the invention to be easily moved or for gripping against the ice.

BRIEF DESCRIPTION OF THE DRAWINGS

The object and advantages of the invention will become readily apparent from the following specification and claims, and with reference to the appended drawings, in which:

DESCRIPTION OF THE PREFERRED EMBODIMENT

Figure 1:
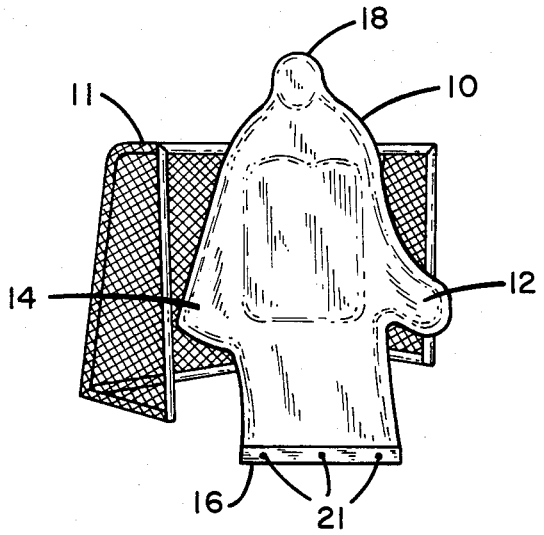
FIG. 1 shows a front view of the invention.

Referring first to FIG. 1 there is shown a front elevational view of the invention. A life-size profile 10 is constructed in the silhouette of a goaltender in a crouched position, placed in front of a hockey goal 11, in a typical position that the goaltender would occupy during a hockey game. The profile has an arm projection 12 placed in the defensive position normally occupied by the goaltender's arm. The profile has a second arm projection 14 positioned in its normal defensive position. Projection 14 represents the arm normally used by the goaltender in holding his goaltending stick, and the profile is adapted for the connection or attachment of a goaltending stick thereto. A base bumper 16 extends across the lower edge of the profile 10, and is formed of a hard material such as wood. Base bumper 16 is necessary for deflecting the large number of pucks which slide into the profile 10 over the ice. The profile 10 has a head projection 18 sized proximate the same size as a goaltender's head enclosed in a helmet.

Figure 2:
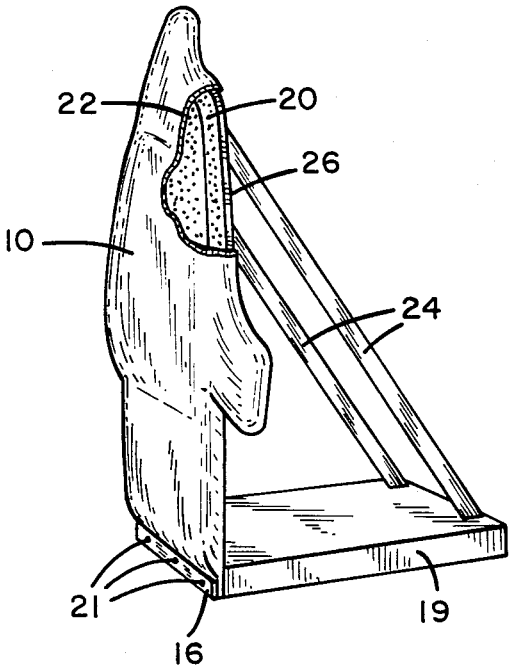
FIG. 2 shows a side elevation view of the invention.

FIG. 2 shows a side isometric view of the invention, illustrating a base support member 19 which projects rearwardly behind profile 10. Profile 10 may be rigidly attached to base member 19 by means of a plurality of bolts or lag screws 21 which pass through base bumper 16, profile 10 and into base member 19. Alternatively, as will be hereinafter described, base member 19 may be hinged to profile 10. One or more braces 24 are attached to base 19, and also attached proximate an upper rear portion of profile 10 in order to provide structural support for profile 10. A portion of profile 10 is shown in cutaway in FIG. 2, to illustrate the overall construction of the profile. A rear board surface 26, formed of plywood or similar sheet material, serves as a backing and support plate for the construction of the profile 10. An inner resilient material such as plastic or rubber foam material 20 is placed over the front surface of board 26. An outer covering 22 of canvas, reinforced plastic, or other similar material is stretched over the entire resilient foam layer, and is fastened against the rear of profile 10. Covering 22 is stretched so as to cause at least a partial compression of the foam material 20 between covering 22 and board surface 26. The overall structure is intended to provide a resilient pad for not only deflecting pucks which may be shot against it, but also for providing rebound forces to cause the pucks to return generally in the directions from which they are shot. In the preferred embodiment, braces 24 are removably bolted to the rear of profile 10 and to the top of base support member 19. Lag screws 21 may be removed to disconnect profile 10 from base member 19, and the entire assembly may then be packed for storage.

Figure 3:
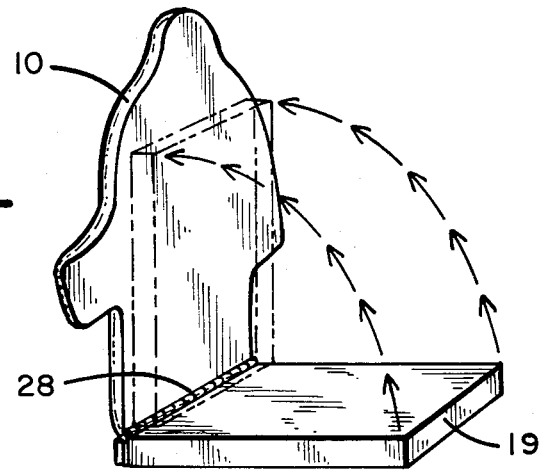
FIG. 3 shows a rear isometric view of an embodiment of the invention.

An alternative construction is shown in FIG. 3, wherein profile 10 is attached to base member 19 by means of a hinge 28 extending across the rear intersecting line of the members. In this embodiment, it is contemplated that brace members 24 may still be utilized in their removable form, but base member 19 may be foldably placed against the rear surface of profile 10 for storage, as is shown in dotted outline.

Figure 4:
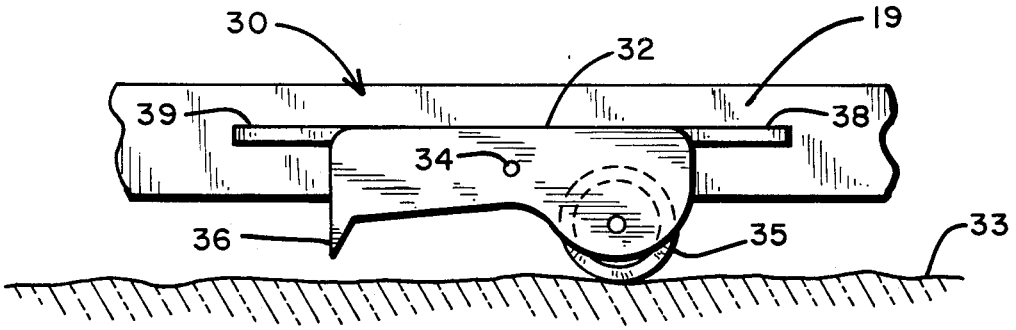
FIG. 4 shows a view of a further embodiment of the invention.

FIG. 4 shows a wheel assembly 30 which may be used with the present invention. Wheel assembly 30 is attachable to base member 19 at two or more locations. Base member 30 includes a housing 32 which is pivotally attached to base member 19 on axle 34. Housing 32 has a freely rotatable wheel 35 attached thereto proximate one end, and has a point 36 formed proximate its other end. A pair of levers 38 and 39 may be selectively depressed, as for example by a foot, to cause housing 30 to pivotally move about axle 34 and bring into contact with the ground or ice surface either wheel 35 or point 36. Housing 30 may be latchably attached to base member 19 according to principles well-known in the art.

Figure 5:
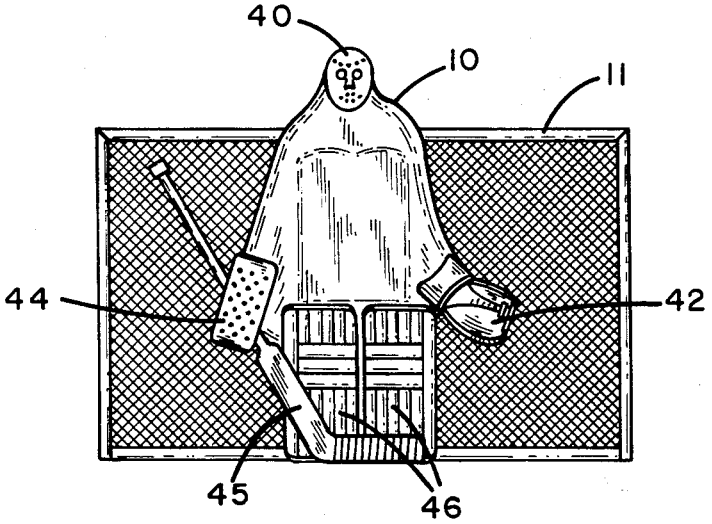
FIG. 5 shows a front view of a further embodiment of the invention.

FIG. 5 shows profile 10 positioned in front of a goal 11, and equipped with standard items of hockey equipment. A face mask 40 may be fitted onto head projection 18 by using the adjustable straps typically provided with face masks of this type. Goaltender gloves 42 and 44 may be respectively attached to arm projections 12 and 14 to more closely simulate actual hockey conditions. A goaltender's stick 45 may be attached to the rear surface of arm projection 14 to further increase the realistic simulation under practice conditions. Finally, leg pads 46 may be attached to profile 10 by strapping them around the rear surface of profile 10 and coupling them together. The goaltender profile 10 shown in FIG. 5 then closely represents not only the actual goaltender's silhouette, but also includes standard goaltender equipment to increase the realism in practice situations.

Figure 6:
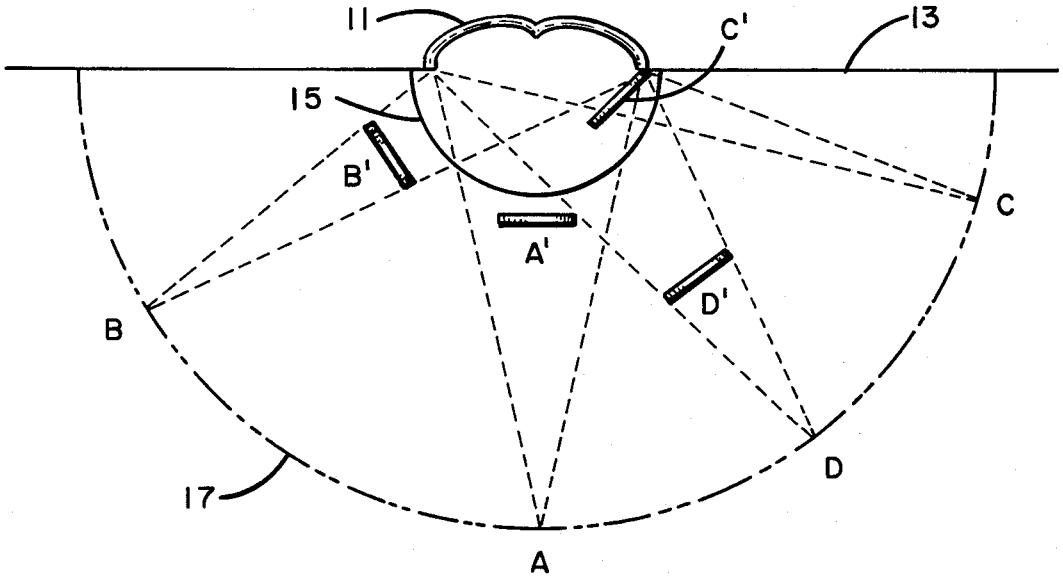
FIG. 6 shows a diagram of several shooting and goaltending positions.

FIG. 6 shows a diagram of a number of typical hockey shooting positions, in relationship to typical goaltender defensive positions. For example, if a shooter is positioned at position A, the goaltender is typically positioned at A′, and the shooting angle is represented by the dotted outlines extending from the respective edges of goal 11 to a vertex formed at point A. This situation represents the best percentage shooting position, for the goal tender A′ must defend the widest possible shooting angle. For other shooting angles, the goaltender will typically move outwardly or inwardly from goal crease 15, which is a circular arc marked on the ice in front of goal 11 and forward of goal line 13. For example, for a shooter positioned at B, goaltender B′ typically moves to a position outside of crease 15 to cover as much of the potential shooting angle as possible. By contrast, at a shooting position C, goaltender C′ may move inside of goal crease 15 to defend not only against the direct shot, but also against rebound shots which are likely to occur. Positions D and D′ represent a further shooting offensive and defensive position wherein the goaltender moves considerably outwardly from goal crease 15.

In operation, the invention may be used in a plurality of positions which are typified by the position shown in FIG. 6. In any of these positions, a practice session may require all of the offensive players to take turns in shooting from a specified point corresponding to the position selected for the goaltender. The goaltender profile 10 may be prepositioned to any of a plurality of defensive positions, and the team may then practice play routines which require making a shot from a specified point on the ice. The invention also contemplates the possibility of profile 10 being movable over the ice, even during the course of practice sessions. In this situation, profile 10 would be supported on its wheels, and a person may stand behind profile 10 and move it from position to position as the practice session progresses. If this convention is adopted, handles and other protective shields may be added to profile 10 to facilitate its use therefore.

As has herein been described, the realism in using profile 10 as a practice goaltender may be enhanced by the addition of various items of goaltender equipment such as gloves, pads and stick. However, the addition of items of equipment is not required for the optimum functioning of the practice goaltender in its most essential form.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A practice goaltender for ice hockey and the like, comprising (a) a vertically aligned sheet cut into the general shape of a goaltender silhouette;

(b) a base member hingedly attached at the bottom of said sheet and extending rearwardly therefrom;

(c) a resilient material layer covering the front surface of said sheet;

(d) an outer covering over said resilient layer, attached along the rear surface of said sheet and at least partially compressing said resilient material layer; and (e) at least one support brace extending proximate the rear top of said sheet to proximate the rear of said base member;

(f) a pivotal assembly attached to said base member, said assembly including a wheel member and a pointed member, and means for pivoting to engage either member with the ground or ice; and (g) a base bumper attached to said sheet across the bottom front surface of said outer covering.

2. The apparatus of claim 1, further comprising means for attachment of a hockey goaltender stick to said sheet.

* * * * *